US012735967B1

(12) United States Patent
Wang et al.

(10) Patent No.: US 12,735,967 B1
(45) Date of Patent: Sep. 15, 2026

(54) METHOD OF STAGED REFRACTURING FOR FRACTURED WELL

(71) Applicant: Chongqing University, Chongqing (CN)

(72) Inventors: Hanyi Wang, Chongqing (CN); Xiangyue Wei, Chongqing (CN)

(73) Assignee: CHONGQING UNIVERSITY, Chongqing (CN)

( * ) Notice: Subject to any disclaimer, the term of this patent is extended or adjusted under 35 U.S.C. 154(b) by 0 days.

(21) Appl. No.: 19/303,689

(22) Filed: Aug. 19, 2025

(30) Foreign Application Priority Data

Mar. 12, 2025 (CN) ..... 202510291661.2

(51) Int. Cl.

| | |
|---|---|
| ***E21B 43/26*** | (2006.01) |
| ***E21B 33/138*** | (2006.01) |
| ***E21B 43/11*** | (2006.01) |
| ***E21B 47/06*** | (2012.01) |

(52) U.S. Cl.
CPC ..... *E21B 43/26* (2013.01); *E21B 33/138* (2013.01); *E21B 43/11* (2013.01); *E21B 47/06* (2013.01)

(58) Field of Classification Search
CPC .... E21B 43/26; E21B 43/2605; E21B 43/261; E21B 43/263; E21B 43/267
See application file for complete search history.

(56) References Cited

U.S. PATENT DOCUMENTS

| | | | | |
|---|---|---|---|---|
| 4,102,401 | A * | 7/1978 | Erbstoesser | E21B 33/138 137/268 |
| 2009/0101334 | A1* | 4/2009 | Baser | E21B 33/138 166/284 |
| 2013/0160998 | A1* | 6/2013 | Auzerais | E21B 47/04 507/104 |
| 2018/0245439 | A1* | 8/2018 | Entchev | E21B 43/14 |
| 2018/0313199 | A1* | 11/2018 | Huang | C09K 8/516 |
| 2018/0371868 | A1* | 12/2018 | Wehrenberg | C09K 8/426 |
| 2024/0026766 | A1* | 1/2024 | Johnson | E21B 43/267 |

* cited by examiner

*Primary Examiner* — Kristyn A Hall
(74) *Attorney, Agent, or Firm* — Tutunjian & Bitetto, P.C.

(57) ABSTRACT

This application belongs to the technical field of oil and gas exploitation and provides a method of staged refracturing for a fractured well. The method includes re-perforating a target wellbore to form a new perforation where a position of the new perforation is different from a position of an old perforation of the wellbore. A fracturing fluid is injected into a first fracturing stage of the target wellbore to stimulate new and old fractures. A fluid containing a plugging agent is injected into the wellbore for plugging the perforations in the target wellbore, with a portion of the plugging agent entering the perforations. A perforation plugging effect is checked with fracturing monitoring data, and the refracturing of the current stage is completed. A packer is slid into place using tubing to a second fracturing stage, and repeating the above steps until the refracturing of the whole wellbore section is completed.

8 Claims, 4 Drawing Sheets

METHOD OF STAGED REFRACTURING FOR FRACTURED WELL

CROSS REFERENCE TO RELATED APPLICATION

This patent application claims the benefit and priority of Chinese Patent Application No. 2025102916612, filed with the China National Intellectual Property Administration on Mar. 12, 2025, the disclosure of which is incorporated by reference herein in its entirety as part of the present application.

TECHNICAL FIELD

The present application belongs to the technical field of oil and gas exploitation, and in particular, to a method of staged refracturing for a fractured well.

BACKGROUND

At present, the hydraulic fracturing technology has become an important measure to enhance the production in oil and gas wells. However, when the oil and gas wells are stimulated for the first time, the scale of fracturing is insufficient due to restrictions of factors such as fracturing equipment, process, and material, failing to create effective propped fractures. Alternatively, as time goes on, the fractures are gradually closed under the action of the in-situ stress and formation fluid flow channels are plugged. Accordingly, a refracturing technique needs to be adopted to improve the stimulation effect and increase the production. During initial fracturing, the wellbore is loaded with and damaged by a high-pressure fluid. Consequently, the casting strength and integrity of the casing may be compromised, and the perforations may show an irregular shape such as oval, bullet shape, and rectangle. Therefore, preserving the integrity and strength of the wellbore after the initial fracturing by effective techniques are still challenges for refracturing. Existing specific techniques mainly include a casing-in-casing technique, a mechanical isolation (packer-based) technique, and a chemical temporary plugging technique.

The casing-in-casing refracturing technique involves lowering and cementing a small-size casing into a target wellbore and plugging the entire perforated interval. However, this drastically reduces the inner diameter of the wellbore, severely limiting the operating pressure and the injection rate of refracturing, while also increasing the operation time and the cost.

The mechanical isolation (packer-based) technique involves using packers to isolate a well section needing to be stimulated and then injecting with tubing for secondary fracturing. The technique frequently used at present is also referred to as a dual-packer single-stage sliding fracturing process featuring the problems of a fixed spacing between the packers, high positioning difficulty, and the like. An expansion tube wellbore stimulation technique is to lower an expansion tube into a target wellbore and to expand the expansion tube hydraulically or by means of an instrument such that a rubber or metal sealing material outside the tube is pressed to provide a reliable seal between the expansion tube and the casing to plug the old perforation. However, a high requirement is imposed on the strength of the expansion tube, and the longer the target wellbore to be stimulated, the more difficult the implementation process and the higher the cost, etc.

The chemical temporary plugging refracturing technique (also referred to as Bullhead Refrac technique) is to reperforate an old fractured well at a new position different from the original perforation position, and then to inject a fluid containing a temporary plugging agent (also referred to as diverting agent) into the well for fracturing. In the fracturing process, the temporary plugging agent will randomly plug part of perforations with a large fluid injection volume. The purpose of making new fractures in batches is achieved by injecting the temporary plugging agent in batches to plug perforations at different positions in the fracturing process. While cost-effective, the temporary plugging effect is uncontrollable. This is because it's impossible to predict which perforations each batch of fracturing fluid and diverters will enter, or from which perforations new fractures will initiate.

The existing patent application No. CN108625841A discloses a method of refracturing with horizontal well annulus sealing and reinforcement combined with a ball dropping sliding sleeve. Tubing with a smaller inner diameter is lowered into the old wellbore of a horizontal well cemented and completed by a casing. A temporary plugging agent is injected into the annulus between the tubing and the casing. After the sealing and reinforcing operation on the tubing-casing annulus of the horizontal section is finished, a new fracturing channel is formed. The packing between stages using the temporary plugging material is combined with the ball dropping sliding sleeve for staged fracturing.

The above-mentioned prior art has the following limitations: (1) Sealing the entire annulus reduces the wellbore internal diameter, limiting injection rate and pressure. (2) High cost of multi-stage isolation materials. (3) Difficulty in accurately positioning between ball dropping sliding sleeve packers. (4) Requirement to inject a breaker into the annulus to resume production.

In addition, fracturing using the ball dropping sliding sleeve has the following drawbacks: (1) High manufacturing and operational costs for sleeves and supporting tools. (2) The sleeve systems occupy space in the wellbore, potentially restricting tool movement, especially in small-diameter wells, impacting flexibility for subsequent operations; (3) Due to the progressively increasing size of the balls, the number of stages is typically limited (around 15-30 stages). Excessive stages lead to oversized balls causing excessive hydrostatic pressure or hindering ball passage; (4) In long horizontal or highly deviated wells, ball passage can be affected by friction or wellbore complexity, leading to deployment failure or inability to reach the target sleeve accurately.

The existing patent application No. CN105275442A discloses a refracturing process for stimulated reservoir volume (SRV) in old wells. The application includes: screening based on reservoir temperature, pressure, water cut, salinity, and fracturing fluid type, followed by dynamic and static performance evaluation to determine the required fracturing fibers and particulate diverting agents. It aims to temporarily plug old fractures for diversion to create new fractures and expand the stimulated area. The patent No. CN107587867A discloses a refracturing process to enhance shale fracture network complexity. For candidate intervals, it establishes a stress equilibrium equation for discrete fractures to determine fracture diversion pressure, then determines diverting agent strength and dosage based on fracture height, particle settling rate, etc., and finally calculates the operational rate for fracture diversion and extension during refracturing.

The two techniques mentioned above have the following limitations: (1) Lack of post-fracturing evaluation for the plugging effectiveness of particulate diverters in old fractures, failing to ensure the effectiveness of fracture diversion; (2) Failure to effectively utilize hydrocarbon resources between old fractures in the near-wellbore region.

The existing patent applications No. CN105275442A and No. CN107587867A are related to the technique of chemical temporary plugging refracturing in batches in essence. That is, it is impossible to predict which perforations the fracturing fluid and diverters will enter, nor from which perforations new fractures will initiate.

Therefore, in order to increase the recovery rate of fractured oil and gas wells, there is an urgent need for a method of staged refracturing for an old fractured well with low stimulation costs and controllable stimulation outcomes.

SUMMARY

The present application proposes a method of staged refracturing for a fractured well so as to solve the problem that staged fracturing cannot be achieved by the chemical temporary plugging refracturing technique without a fixed downhole packer device in the prior art.

To solve the above technical problems, the present application adopts the following technical solutions:

A method of staged refracturing for a fractured well includes:

re-perforating a target wellbore to form a new perforation, where the target wellbore has an old perforation, and a position of the new perforation is different from a position of the old perforation;

dividing the target wellbore into at least two fracturing stages, and refracturing the fracturing stages in sequence, where the refracturing includes:

injecting a fracturing fluid into a current fracturing stage of the target wellbore to stimulate new and old fractures;

injecting a fluid containing a plugging agent into the current fracturing stage of the target wellbore for plugging the perforations in the fracturing stage, the perforations including the new perforation and the old perforation; and determining a perforation plugging effect based on fracturing monitoring data, the perforation plugging effect including successful plugging and failed plugging; when the perforation plugging effect is successful plugging, completing the refracturing of the current fracturing stage, and refracturing a next fracturing stage; and when the perforation plugging effect is failed plugging, continuing to inject the fluid containing the plugging agent into the fracturing stage of the target wellbore until the perforation plugging effect is successful plugging.

Preferably, after the refracturing of the current fracturing stage is completed, a packer is slid using tubing to the next fracturing stage for refracturing.

Preferably, when the old fracture affects initiation of a new fracture, the method includes:

when the new perforation and the old perforation are in a concentrated distribution, shortening a length of the current fracturing stage, isolating, using a packer, the old perforation and the new perforation as separate fracturing stages, and then carrying out the refracturing; and when the new perforation and the old perforation are in a cross distribution, maintaining the fracturing stage, controlling a pressure of the fracturing fluid to be only sufficient to fracture the old fracture, then injecting the plugging agent to plug the old perforation, and finally, reinjecting the fracturing fluid to the new perforation to create the new fracture.

Preferably, the plugging agent includes a deformable portion and a rigid portion; and under the action of the fluid, the deformable portion enters the perforations, while the rigid portion stays in the target wellbore, providing bidirectional anchoring.

Preferably, a density of the plugging agent is lower than or equal to a density of the fluid.

Preferably, the fracturing monitoring data is a bottom hole pressure which is obtained by monitoring of a wellhead pressure and calculation using a wellbore flow model.

Preferably, the determining a perforation plugging effect based on fracturing monitoring data includes:

when the bottom hole pressure reaches or exceeds a formation rock breakdown pressure, determining that the perforation plugging effect is successful plugging; and when the bottom hole pressure fails to reach the formation rock breakdown pressure, determining that the perforation plugging effect is failed plugging.

Preferably, the plugging agent is degradable.

Preferably, the plugging agent includes at least one deformable plugging agent.

Preferably, the plugging agent is introduced during the refracturing, and before the completion of the refracturing, the plugging agent is introduced again; and a plugging pressure test is conducted to obtain the fracturing monitoring data.

The present application has the following beneficial effects:

According to the method of staged refracturing for a fractured well provided by the present application, on the one hand, the plugging agent having the deformable portion and the in rigid portion is used so that the fracture perforations can be effectively plugged during stimulation. The plugging agent has a bidirectional anchoring capability of preventing falling and inward squeezing. Even through the pressure in the perforation is greater than the pressure in the wellbore, the plugging agent is not easy to fall, and the plugging agent can also be adapted to special-shaped perforations in the wellbore. On the other hand, by the method of sliding the packer using the tubing, the refracturing on the wellbore stages can be achieved. Part of existing fracture perforations are plugged first and then the fracturing fluid is pumped into a selected part of fracture perforations, so that the initiation location of the new fracture can be controlled accurately. Meanwhile, requirements on surface operational equipment are reduced (e.g., a lower injection rate and a lower pressure rating), and the simulation cost is reduced.

BRIEF DESCRIPTION OF THE DRAWINGS

In order to more clearly illustrate technical solutions in the embodiments of the present application or in the prior art, a brief introduction to the drawings required for the description of the embodiments or the prior art will be provided below. In all the accompanying drawings, similar elements or portions are generally identified by similar reference numerals. In the accompanying drawings, each element or portion is not necessarily drawn to the actual scale. Apparently, the accompanying drawings in the following description show merely some embodiments of the present application, and those of ordinary skill in the art may still derive other drawings from these accompanying drawings without creative efforts.

DETAILED DESCRIPTION OF THE EMBODIMENTS

Figure 1:
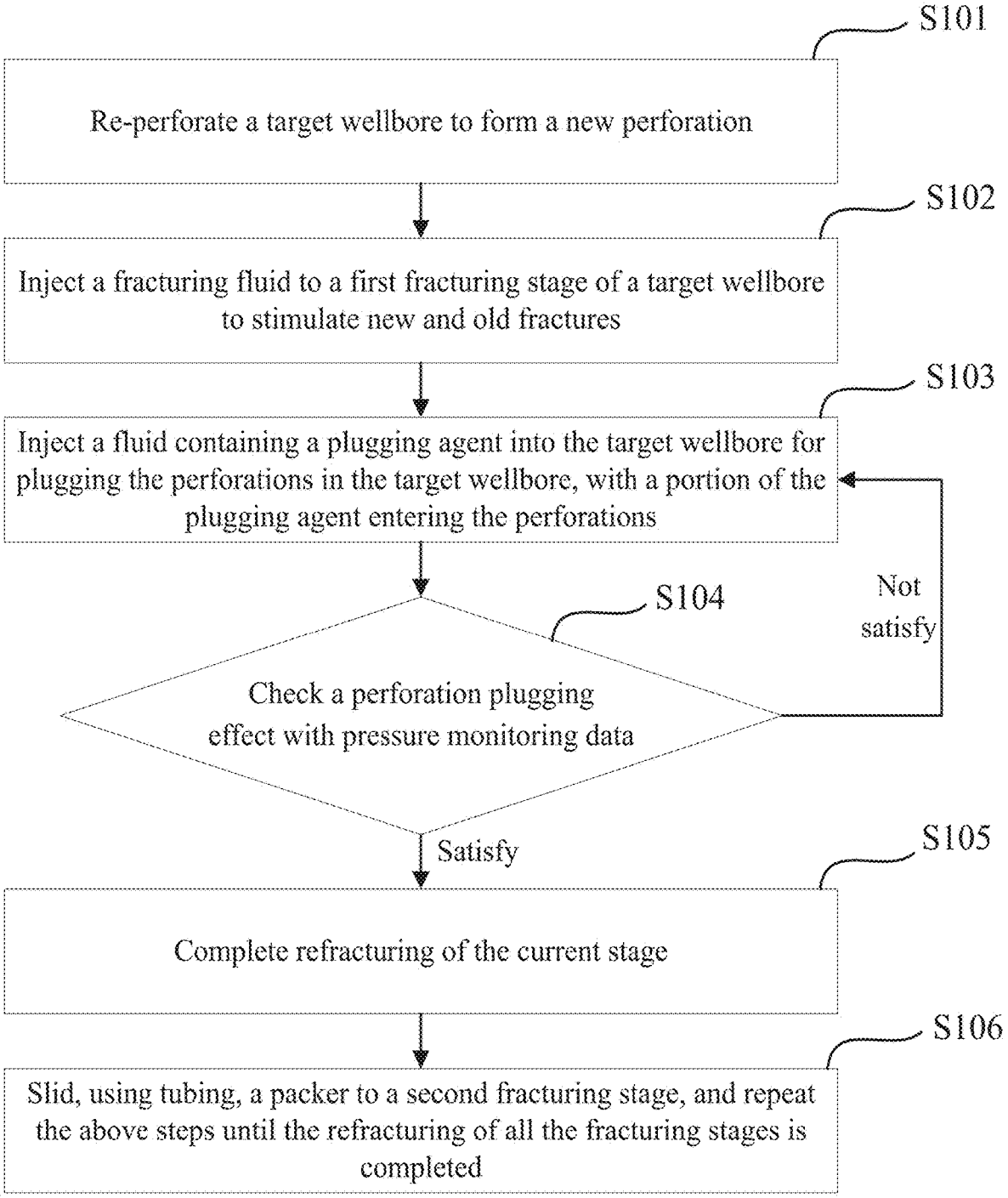
FIG. 1 is a flowchart I of a method of staged refracturing for a fractured well provided by an embodiment of the present application.

In order to make the objective, technical solutions, and advantages of the present application clearer, the technical solutions of the present application will be clearly and completely described below in conjunction with the accompanying drawings in the embodiments of the present application. Apparently, the described embodiments are merely some rather than all of the embodiments of the present application. All other embodiments obtained by a person of ordinary skill in the art based on the embodiments of the present application without creative efforts shall fall within the protection scope of the present application.

In order to solve the problems of inadequate plugging using a plugging material, incomplete utilization of a core horizon, high positioning difficulty in refracturing of a new fracture, and the like in the existing refracturing techniques, an embodiment of the present application provides a method of staged refracturing for a fractured well. The method includes the following steps: a target wellbore is re-perforated to form a new perforation, where the target wellbore has an old perforation, and a position of the new perforation is different from a position of the old perforation. The target wellbore is divided into at least two fracturing stages, and the fracturing stages are refractured in sequence, where the refracturing includes the following steps: a fracturing fluid is injected into a fracturing stage of the target wellbore to stimulate new and old fractures; and a fluid containing a plugging agent is injected into the fracturing stage of the target wellbore for plugging the perforations in the fracturing stage, with a portion of the plugging agent entering the perforations, and the perforations includes the new perforation and the old perforation. A perforation plugging effect is determined based on fracturing monitoring data, the perforation plugging effect including successful plugging and failed plugging. When the perforation plugging effect is successful plugging, the refracturing of the current fracturing stage is completed, and next fracturing stage is refractured. When the perforation plugging effect is failed plugging, injecting the fluid containing the plugging agent into the fracturing stage of the target wellbore is continued until the perforation plugging effect is successful plugging.

In the following embodiments of the present application, the implementation process of the method of staged refracturing for a refractured well will be set forth in detail by taking a target wellbore including a first fracturing stage and a second refracturing stage as an example. It needs to be noted that the first fracturing stage and the second refracturing stage mentioned here do not mean that the method proposed in the present application is only suitable for staged refracturing of a refractured well with two fracturing stages. The embodiments are merely examples and are not intended to limit the present application.

Embodiment 1

FIG. 1 is a flowchart of a method of staged refracturing for a fractured well by an embodiment of the present application. As shown in FIG. 1, an embodiment of the present application provides a method of staged refracturing for a fractured well. In the present embodiment, a horizontal well is taken as an example. It needs to be noted that the method is also suitable for a vertical well and a slant well. The method includes specific steps S101 to S106.

In step S101, a target wellbore is re-perforated to form a new perforation.

Figure 2:
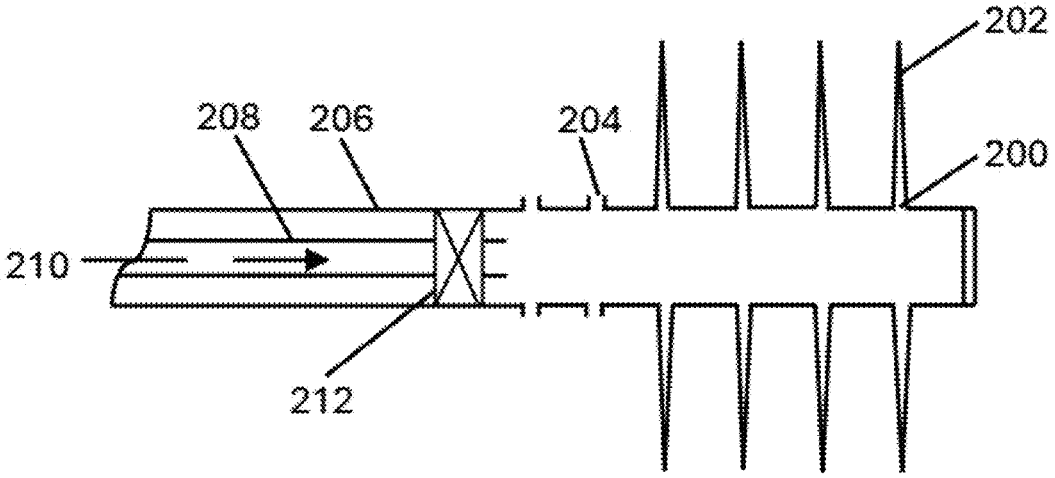
FIG. 2 is a schematic diagram of starting to plug a first fracturing stage of a target wellbore provided by an embodiment of the present application.

In step S101, with a pump, a perforating gun (not shown) is lowered, by using a cable, to a first designed new perforation 204 as shown in FIG. 2 from a wellhead. Subsequently, the perforating gun is sequentially slid to next designed perforation. The perforating gun is taken out until the designed perforations in the whole wellbore section are completed. The position of the new perforation 204 is different from the position of an old perforation 200.

In some embodiments, before perforating the target wellbore 206, a candidate well is identified. Parameters such as reservoir quality, well completion, and yield are selected. The number of perforations and positions thereof are designed. In some embodiments, before refracturing, a target well, perforation parameters, and fracturing parameters can be selected by establishing a physical model and studying influences of different factors on the refracturing effects.

In step S102, a fracturing fluid is injected into the first fracturing stage of the target wellbore to stimulate new and old fractures.

In step S102, as shown in FIG. 2, tubing 208 with a packer 212 is lowered to the designed position of the first fracturing stage in the target wellbore 206. The fracturing fluid 210 is injected to the first fracturing stage to stimulate an old fracture 202 and a new fracture 214 shown in FIG. 3. There are a plurality of new fractures. A formation exudate or a product enters the wellbore through the new fracture 214 and the new perforation 204, and can be extracted on the ground.

In some embodiments, the packer 212 may be made of a soluble material.

In some embodiments, the tubing 208 may be any pipe that can transport a fluid.

In some embodiments, the fracturing fluid 210 is typically a water-based or an oil-based fluid. Except in undersaturated formations, it is proven that the water-based fracturing fluids are harmless. In unsaturated reservoirs, early screening and a low recovery rate after treatment may occur. In this case, the oil-based fluid is used for refracturing so that the yield can be increased.

In step S102, preferably, 3 to 5 original hydraulic fracturing stages can be united into a new re-fracturing stage. The united new re-fracturing stage has a total number of perforations of less than 200.

In step S103, a fluid containing a plugging agent is injected into the target wellbore for plugging the perforations in the target wellbore, with a portion of the plugging agent entering the perforations.

Figure 3:
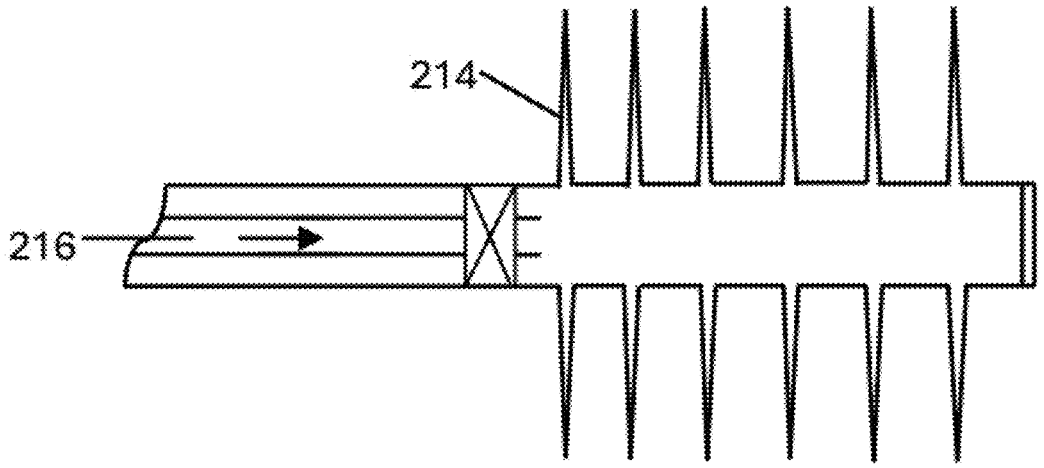
FIG. 3 is a schematic diagram of a pressure test on the plugged first fracturing stage of the target wellbore provided by an embodiment of the present application.
Figure 4:
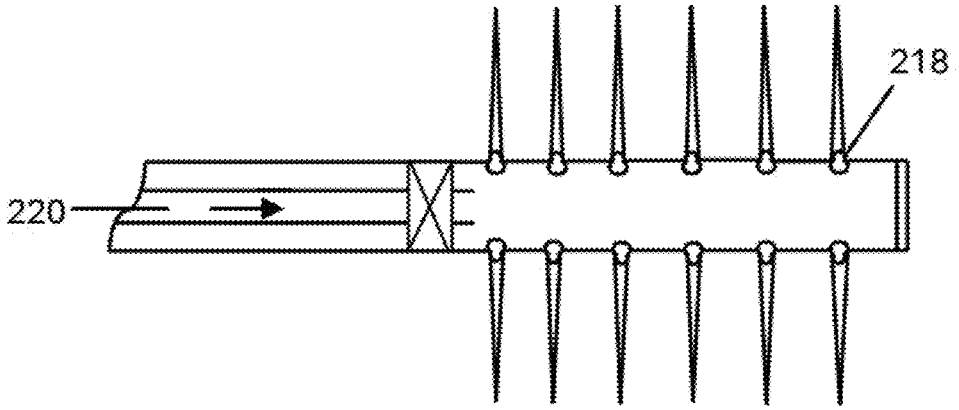
FIG. 4 is a schematic diagram of a pressure test on the plugged first fracturing stage of the target wellbore provided by an embodiment of the present application.

In step S103, as shown in FIG. 3, the fluid 216 containing the plugging agent is pumped into the first fracturing stage through the tubing 208 to plug the old perforation 200 and the new perforation 204, preventing the perforations in the first fracturing stage from affecting the fracturing of the second fracturing stage. As shown in FIG. 4, the plugging agent 218 is carried by a high-pressure injected fluid to enter the perforation 200 of the old fracture 202 and the perforation 204 of the new fracture 214 in a low-pressure zone, where a deformable portion of the plugging agent 218 is squeezed into the perforations under the action of a pressure difference between the target wellbore 206, and the new fracture 214 and the old fracture 202.

In some embodiments, before the plugging agent is pumped to the first fracturing stage of the target wellbore 206 to plug the fracture perforations, the formation energy needs to be replenished by using a pre-pad fluid. The formation pressure in the low-pressure zone is replenished, avoiding the fractures from all extending in the low-pressure region.

In some embodiments, the plugging agent 218 may include at least one deformable plugging agent. For example, the plugging agent 218 includes a deformable portion and a rigid portion. By "plug-in plugging", the deformable portion of the plugging agent is squeezed into the perforations, while the rigid portion stays in the wellbore. The plugging agent has a bidirectional anchoring capability and can be adapted to special-shaped perforations that may exist.

In some embodiments, the deformable portion may be filled with any one or a mixture of several of solid particles, a liquid, and a gas.

Preferably, the rigid portion is made of a rigid material, e.g., a high-molecular polymer such as polypropylene, polyethylene, carbonates, and metals, to avoiding that the plugging agent is completely sunk into the perforations.

In some examples, the number of plugging agents is usually equal to the number of perforations in the stimulation interval. Moreover, a plugged layer formed by the plugging agent can resist a pressure of more than 25 MPa.

In step S104, a perforation plugging effect is checked with pressure monitoring data. If the perforation plugging effect meets a preset standard, step S105 is performed. If the perforation plugging effect does not meet the preset standard, step S104 is performed again.

In step S104, as shown in FIG. 4, after the plugging of the first fracturing stage is completed, a pressure testing fluid 220 is injected through the tubing 208 to perform a pressure test on the first fracturing stage.

The pressure testing fluid for the pressure test typically contains similar components to the fracturing fluid.

It needs to be noted that the plugging effect of the plugging agent can be evaluated according to a dynamic relationship between a wellhead pressure and a bottom hole pressure that is established in combination with a wellbore flow model.

In some embodiments, determination is made based on fracturing pressure curve data. After the plugging agent is injected, the bottom hole pressure rises rapidly, and the number of the perforations plugged increases continuously, and the stimulation pressure rises gradually accordingly. The plugging effect is evaluated by pressure monitoring. If the bottom hole pressure can rise above a formation rock breakdown pressure, the plugging is successful. If the bottom hole pressure cannot rise above the formation rock breakdown pressure, injecting the plugging agent to the wellbore is continued until the bottom hole pressure can rise above the formation rock breakdown pressure.

Formation breakdown pressure is a key parameter in well drilling and fracturing design. The formation breakdown pressures at different depths can be obtained by a plurality of methods, e.g., by field measurement (such as overflow testing, formation integrity testing, mini-fracturing testing, and stepwise pressure loading testing), an empirical formula, a rock mechanics model equation, logging data, numerical modeling, etc.

Furthermore, in some embodiments, during refracturing, technical means such as a proppant tracer, microseismic monitoring, production logging, a distributed temperature/acoustic wave sensing system, and surface operational pressure analysis can be adopted for stimulation monitoring. By means of these means, not only can real-time control and adjustment of stimulation be performed, but also the orientation and the stimulation effect of the refractured fractures can be evaluated.

In step S105, the refracturing of the current stage is completed.

In step S106, the packer is slid by the tubing to the second fracturing stage, and the above steps are repeated until the refracturing of all the fracturing stages is completed.

Figure 5:
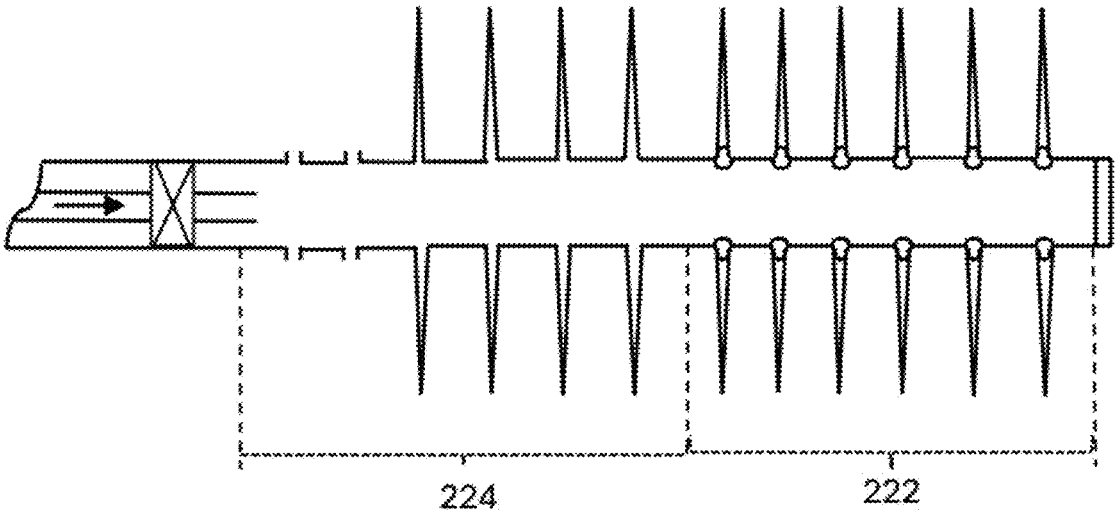
FIG. 5 is a schematic diagram of starting stimulation on a second fracturing stage of the target wellbore provided by an embodiment of the present application.

In some embodiments, as shown in FIG. 5, after the stimulation on the first fracturing stage 222 is completed, the tubing 208 and the packer 212 are slid to a preset position of the second fracturing stage 224, and steps S101 to S105 are repeated.

In the present embodiment, the packer 212 is bottom-sealed and slid by the tubing 208 for refracturing. Compared with the traditional "dual-packer single-stage" way, the interval needing to be stimulated can be positioned better. Moreover, the casing within the fracturing stage has a large diameter and higher injection rate, and the perforations are not affected by the casing.

Furthermore, in some embodiments, if the plugging of a certain refracturing stage cannot be completed after the plugging agent is introduced for a plurality of time (the pressure test shows that the plugging effect is poor), it may be considered that a bridge plug is used for packing (to isolate current fracturing stage from previous fracturing stages).

Embodiment 2

In the actual operation process, when hydraulic fracturing is performed on the first fracturing stage, old fractures and new perforations coexist. If the fracturing fluid only can preferentially enter an old fracture at a low pressure, and the wellbore pressure at a new perforation is lower than the formation breakdown pressure, resulting in a failure to create a new fracture.

In order to solve the problem that may occur in the prior art, unlike Embodiment 1, when the distribution of old perforations and the new perforations is concentrated, in the present embodiment, the fracturing stage is shortened, the wellbore stage of the old fractures and the stage of the new perforations are taken as separate fracturing stages, respectively, so as to accurately control the forming of new fractures.

Figure 6:
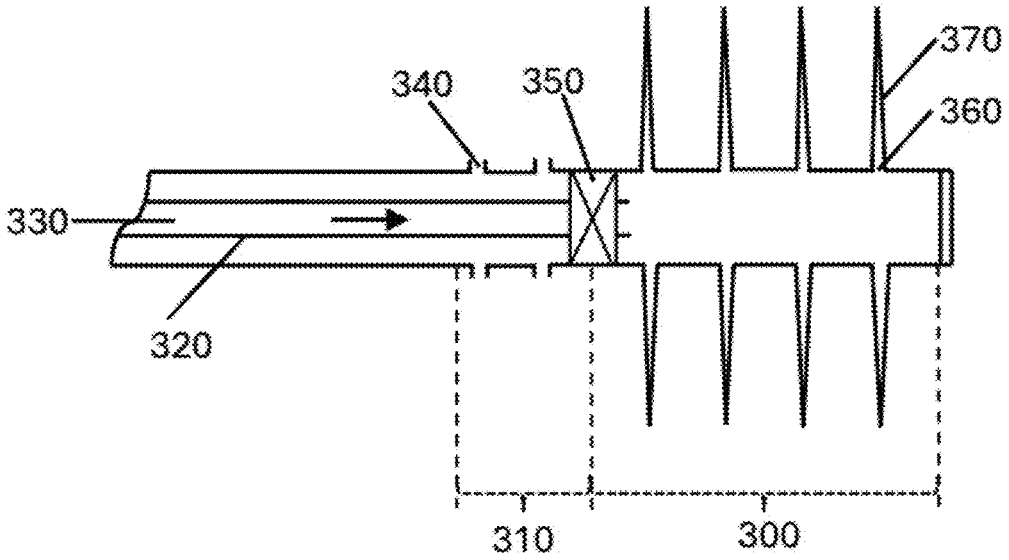
FIG. 6 is a schematic diagram of staged fracturing on wellbore stages with new and old perforations provided by an embodiment of the present application.

For example, in one embodiment of the present application, as shown in FIG. 6, after re-perforating of the whole wellbore is completed according to a design scheme, tubing 320 and a packer 350 are lowered to the first fracturing stage 300 at the designed position in the target wellbore, where the first fracturing stage 300 includes only the wellbore stage with the old fractures 370. A fracturing fluid 330 is then injected to the tubing 320 to further fracture the old fractures 370 (it needs to be noted that this operation can be omitted if the old fractures 370 have no available oil and gas). After the completion of fracturing, a plugging agent is injected into the tubing 320 to plug the old perforations 360 in the first fracturing stage 300. After plugging pressure testing is successful, the tubing 320 and the packer 350 are slid to the second fracturing stage 310 at the designed position, where the second fracturing stage 310 includes only the wellbore stage with the new perforations 340. The operation in the first fracturing stage 300 is repeated. The whole refracturing process includes cyclic operations on the wellbore stage with the old fractures and the wellbore stage with the new perforations until the last designed fracturing stage is completed.

In the present embodiment, the pressure of pumping the fracturing fluid can be adjusted according to the fracturing pressures required for the wellbore stage with the old fractures and the wellbore stage with the new perforations so as to accurately control the forming of the new fractures.

In some embodiments, when the old fractures have no available oil and gas, the plugging agent may be made of a non-degradable material.

In some embodiments, the plugging agent for plugging the new perforations 340 is usually made of a degradable material. This plugging agent can be naturally degraded after refracturing such that the production of the plugged fractures is recovered.

Embodiment 3

In actual operation, in order to solve the problem of being difficult to create a new fracture when an old fracture and a new perforation coexist in a fracturing stage, unlike Embodiment 1 and Embodiment 2, when the old fractures and the new perforations are in a cross distribution in the wellbore, in the present embodiment, the fracturing stage is maintained, and a method of first plugging an old fracture perforation and then fracturing to create a new fracture is adopted to guarantee the forming of the new fracture.

Figure 7:
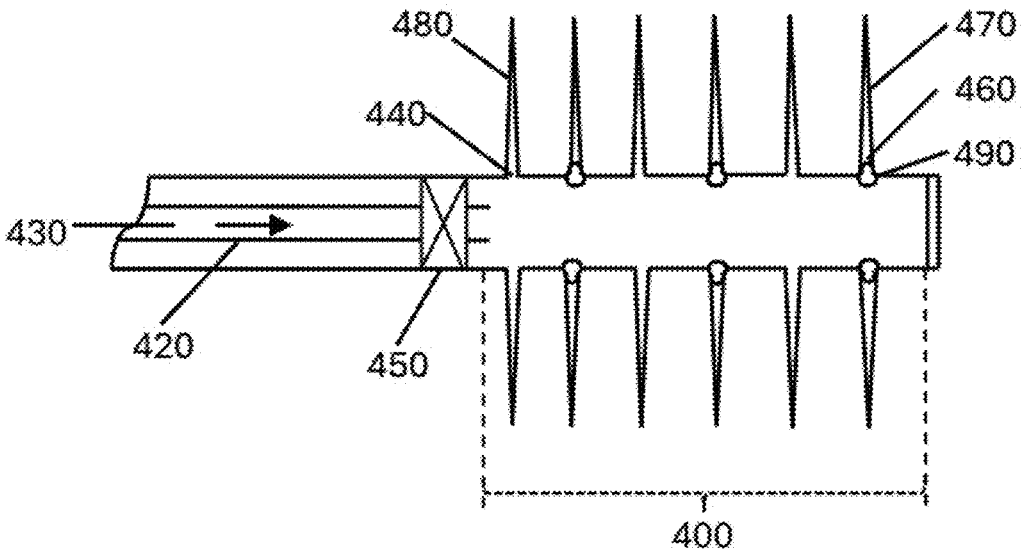
FIG. 7 is a schematic diagram of first plugging an old fracture perforation and then fracturing to create a new fracture provided by an embodiment of the present application.

For example, in one embodiment of the present application, as shown in FIG. 7, tubing 420 and a packer 450 are lowered to the first fracturing stage 400 at the designed position in the target wellbore, where an old fracture 470 and a new perforation 440 coexist and are in the cross distribution. Before a fracturing fluid 430 is injected to create a new fracture 480, the fracturing fluid 430 is first injected into the first fracturing stage 400. The pressure of the fracturing fluid 430 is controlled such that the fracturing fluid can only enter an old perforation 460 to open the old fracture 470, and its pressure cannot reach the rock breakdown pressure at the new perforation 440 (it needs to be noted that this operation can be omitted if the old fracture 470 has no available oil and gas). A fluid containing a plugging agent 490 is then injected to the first fracturing stage 400. Since the new perforation 440 does not receive the fluid continuously, the plugging agent 490 can only enter the old perforation 460 for plugging. After all the old perforations 460 in the first fracturing stage 400 have been plugged and pass the plugging pressure test, the fracturing fluid 430 is then injected to form the new fractures 480. Subsequently, the plugging agent 490 is injected to plug the new perforations 440 and the plugging pressure is tested, thereby completing the refracturing of the first fracturing stage 400. Finally, the tubing 420 and the packer 450 are slid to next designed fracturing stage until the refracturing of the whole wellbore is completed.

Embodiment 4

In the actual operation process, since an old fracture and a new perforation coexist in a fracturing stage, or since the formation rock breakdown pressures at different perforations are different due to the heterogeneity of the formation, the fractures at different positions may not initiate and propagate simultaneously. In the present embodiment, a plugging agent is introduced in the fracturing process of the fracturing stage (which may be introduced in batches for a plurality of times). The stimulation process is the same as that of the traditional temporary plugging fracturing within a stage, with the only difference that the plugging agent needs to be introduced before the completion of the fracturing stage, and the plugging pressure testing needs to be performed.

For example, in one embodiment of the present application, as shown in FIG. 7, the tubing 420 and the packer 450 are lowered to the first fracturing stage 400 at the designed position in the target wellbore. The fracturing fluid 430 is first injected into the first fracturing stage 400 for fracturing, and then the fluid containing the plugging agent 490 is injected to the first fracturing stage 400 for plugging the existing fractures (the injection amount of the plugging agent is controlled such that the plugging agent can plug part of perforations that are receiving the fracturing fluid, but not plug all the perforations in the first fracturing stage 400). Injecting the fracturing fluid containing no plugging agent to the first fracturing stage 400 is continued, and the fracturing fluid enters the other perforations that are not plugged. Finally, the fracturing fluid containing the plugging agent is injected to the first fracturing stage 400 and the plugging pressure is tested, thereby completing the refracturing of the first fracturing stage 400. Finally, the tubing 420 and the packer 450 are slid to next designed fracturing stage until the refracturing of the whole wellbore is completed.

The foregoing embodiments are merely used to explain the technical solutions of the present application, but are not intended to limit them. Although the present application is described in detail with reference to the foregoing embodiments, those of ordinary skill in the art should understand that they may still make modifications to the technical solutions described in the foregoing embodiments, or make equivalent replacements to some or all technical features thereof. These modifications or replacements do not make the essence of the corresponding technical solutions depart from the scope of the technical solutions of the embodiments of the present application, and shall fall within the scope of claims and specification of the present application.

What is claimed is:

1. A method of staged refracturing for a fractured well, comprising:

re-perforating a target wellbore to form a new perforation, wherein the target wellbore has an old perforation, and a position of the new perforation is different from a position of the old perforation;

dividing the target wellbore into at least two fracturing stages, and refracturing the fracturing stages in sequence, wherein the refracturing comprises:

injecting a fracturing fluid into a current fracturing stage of the target wellbore to stimulate new and old fractures;

injecting a fluid containing a plugging agent into the current fracturing stage of the target wellbore for plugging the perforations in the fracturing stage, the perforations comprising the new perforation and the old perforation; and determining a perforation plugging effect based on fracturing monitoring data, the perforation plugging effect comprising successful plugging and failed plugging, wherein the fracturing monitoring data is a bottom hole pressure which is obtained by monitoring of a wellhead pressure and calculation using a wellbore flow model; when the bottom hole pressure reaches or exceeds a formation rock breakdown pressure, determining that the perforation plugging effect is successful plugging completing the refracturing of the current fracturing stage, and refracturing a next fracturing stage; and when the bottom hole pressure fails to reach the formation rock breakdown pressure, determining that the perforation plugging effect is failed plugging, continuing to inject the fluid containing the plugging agent into the fracturing stage of the target wellbore until the perforation plugging effect is successful plugging.

2. The method according to claim 1, wherein after the refracturing of the current fracturing stage is completed, a packer is slid using tubing to the next fracturing stage for refracturing.

3. The method according to claim 1, wherein when the old fracture affects initiation of a new fracture, the method further comprises:

when the new perforation and the old perforation are in a concentrated distribution, shortening a length of the current fracturing stage, isolating, using a packer, the old perforation and the new perforation as separate fracturing stages, and then carrying out the refracturing; and when the new perforation and the old perforation are in a cross distribution, maintaining the fracturing stage, controlling a pressure of the fracturing fluid to be only sufficient to stimulate the old fracture, then injecting the plugging agent to plug the old perforation, and finally, reinjecting the fracturing fluid to the new perforation to create the new fracture.

4. The method according to claim 1, wherein the plugging agent comprises a deformable portion and a rigid portion, and under the action of the fluid, the deformable portion enters the perforations, while the rigid portion stays in the target wellbore, providing bidirectional anchoring.

5. The method according to claim 1, wherein a density of the plugging agent is lower than or equal to a density of the fluid.

6. The method according to claim 1, wherein the plugging agent is degradable.

7. The method according to claim 1, wherein the plugging agent comprises at least one deformable plugging agent.

8. The method according to claim 1, wherein the plugging agent is introduced during the refracturing, and before the completion of the refracturing, the plugging agent is introduced again; and a plugging pressure test is conducted to obtain the fracturing monitoring data.

* * * * *